United States Patent [19]

Chiba et al.

[11] Patent Number: 4,913,991

[45] Date of Patent: Apr. 3, 1990

[54] ELECTROPHOTOGRAPHIC PROCESS USING FLUORINE RESIN COATED HEAT APPLICATION ROLLER

[75] Inventors: Shunichi Chiba, Numazu; Satoru Inoue, Mishima; Akio Matsui, Numazu; Yoshihisa Okamoto, Fuji, all of Japan

[73] Assignee: Ricoh Company, Ltd., Tokyo, Japan

[21] Appl. No.: 181,978

[22] Filed: Apr. 15, 1988

[30] Foreign Application Priority Data

Apr. 17, 1987 [JP] Japan ..... 62-093139
May 28, 1987 [JP] Japan ..... 62-129825

[51] Int. Cl.[4] ..... G03G 13/01; G03G 13/20

[52] U.S. Cl. ..... 430/45; 430/99; 430/111

[58] Field of Search ..... 430/99, 111, 124, 42, 430/45

[56] References Cited

U.S. PATENT DOCUMENTS 3,268,351 8/1966 Van Dorn ..... 430/99
4,196,256 4/1980 Eddy et al. ..... 430/99 X
4,320,714 3/1982 Shimazaki et al. ..... 430/99 X

*Primary Examiner*—Roland E. Martin

*Attorney, Agent, or Firm*—Cooper & Dunham

[57] ABSTRACT

An electrographic process comprising the steps of forming latent electrostatic images on a photoconductive material, developing the latent electrostatic images with a toner to toner images, transferring the toner images to a recording sheet, fixing the toner images to the recording sheet by causing the toner image bearing recording sheet to pass between a heat application roller coated with a fluorine-containing resin and a pressure application roller for fixing to the toner images to the recording sheet, in which electrographic process the rheological characteristics of the toner are such that the loss tangent (tan δ), which is a ratio of the loss moldus (G″) to the storage modulus (G′) of the toner, is in the range of 1.70 to 3.00 when the storage modulus (G′) is $10^5$ dynes/cm$^2$, namely $$1.70 \leqq \tan \delta \leqq 3.00$$

where $$\tan \delta = \frac{\text{Loss Modulus } (G'')}{\text{Storage Modulus } (G')}.$$

3 Claims, 3 Drawing Sheets

ELECTROPHOTOGRAPHIC PROCESS USING FLUORINE RESIN COATED HEAT APPLICATION ROLLER

BACKGROUND OF THE INVENTION

The present invention relates to an electrographic process including an electrophotographic process for the formation of conventional toner images, digital color images and transparent color images by a digital color copying apparatus, or a digital color printer (color image processor).

As a heat application roller for fixing toner images formed by electrophotography to a recording sheet under application of heat thereto, for example, a roller coated with a silicone elastomer and a roller coated with a fluorine-containing resin having a toner-releasable property have been proposed. The resins for the toners for use with such rollers are proposed, for example, in Japanese Patent Publication 55-6895, Japanese Laid-Open Patent Application 50-44836, Japanese Patent Publication 46-12680, and Japanese Laid-Open Patent Application 51-147325.

When full color images are formed by the toners comprising the above resins and fixed by the conventional image fixing method, the above toners have the following drawbacks:

(1) When the toners comprising a styrene-acrylic resin are used, glossy images are hardly obtained, so that they are not suitable for the formation of color images, although the toners do not cause any disadvantageous offset phenomenon. When the fixed images are not glossy, the light reflected by the surface of the images is scattered, since the inner reflection light having a particular color and the scattered reflection light are simultaneously sensed by the eyes, the density of the visible color is decreased and therefore the images look light-colored or faint and are not impressive.

(2) Since the toners comprising a resin having a relatively low molecular weight, such as polyester and epoxy resin, are softened at low temperatures, glossy images can be easily obtained and therefore such toners are suitable for color copying. However, the toners tend to adhere to an image fixing roller and are poor in the releasability from the roller, so that the offset phenomenon is apt to occur. Therefore it is necessary to apply an auxiliary agent such as silicone oil to an silicone-elastomer-coated roller with improved releasability. A Teflon roller does not have a sufficient image fixing temperature range for use in practice.

In a conventional full color copying apparatus, toners of a low-temperature-softening type, and a silicone-oil-applied silicone roller are employed for image fixing. However, the roller with improved releasability has the shortcoming that its life is not long. In order to solve this problem, it may be expected that an image fixing roller made of a fluorine-containing resin will be useful. However, the fact is that a roller made of the fluorine-containing resin is inferior in the toner releasability to the silicone roller, and when a low-temperature-softening type toner is used with the roller made of the fluorine-containing resin, the offset phenomenon is apt to occur and the image fixable temperature range is narrow.

For color hard copies obtained by digital printing, a reproduction method of an area-gradation type is employed as a pseudo-color image gradation method. However, in the above digital printing, since the toners mentioned in the above (2) are employed in combination with the silicone-elastomer-coated roller with improved releasability, glossy images can be obtained. However, reproduction of dot images is not so good, possibly because the melted toner flows into the fibers of the paper. The result is that it is difficult to obtain images with the desired gradation and quality.

SUMMARY OF THE INVENTION

It is therefore an object of the present invention to provide an electrographic process capable of yielding images having appropriate glossiness and high quality by utilizing an area-gradation method, for example, for use in a digital color copier.

According to the present invention, the above object of the present invention can be attained by an electrographic process comprising the steps of forming latent electrostatic images on a photoconductive material, developing the latent electrostatic images with a toner to toner images, transferring the toner images to a recording sheet, and fixing the toner images to the recording sheet by causing the toner image bearing recording sheet to pass between a heat application roller coated with a fluorine-containing resin and a pressure application roller for applying pressure to the toner image so as to be fixed to the recording sheet, in which electrographic process the rheological characteristics of the toner are such that the loss tangent ($\tan\delta$), which is a ratio of the loss modulus (G'') to the storage modulus (G'), is in the range of 1.70 to 3.00 when the storage modulus (G') is $10^5$ dynes/cm$^2$, namely $$1.70 \leqq \tan\delta \leqq 3.00$$

where $$\tan\delta = \frac{\text{Loss Modulus } (G'')}{\text{Storage Modulus } (G')}.$$

In the present invention, it is preferable that an area-gradation method be employed for the reproduction of a continuous image density gradation.

DETAILED DESCRIPTION OF THE PREFERRED EMBODIMENTS

With reference to the accompanying drawings, the mechanism of the formation of a glossy image by the toner for use in the present invention will now be explained.

Figure 1:
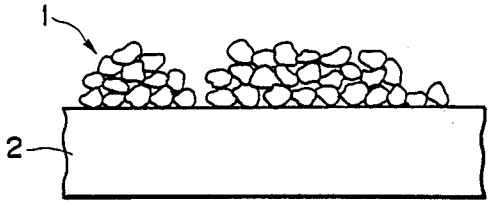
FIG. 1 is a schematic illustration of a toner for use in the present invention which is not fixed to a recording sheet.
Figure 2:
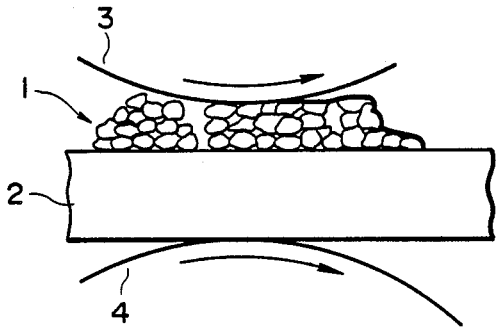
FIG. 2 is a schematic illustration of a process of fixing the toner to a recording sheet.

An unfixed toner 1 which is deposited on a recording sheet 2 as shown in FIG. 1 is caused to enter an image fixing unit and fixed to the recording sheet by the following steps (1) through (3):

(1) As shown in FIG. 2, the unfixed toner 1 is brought into contact with a heat application roller 3. By the heat conduction from the heat application roller 3, the state of the solid toner is changed to a rubber state through a glass transition state.

(2) The toner in a rubber state is plastically deformed between a pair of rollers 3 and 4 by the pressure applied thereto, so that the toner particles are consolidated, and the consolidated toner 1 is firmly fixed to the surface of the recording sheet 2 with partial permeation of the toner into the recording sheet 2. Since the surface of the consolidated toner 1 is in close contact with the heat application roller 3, the surface of the toner 1 is fused, so that a fused surface layer 5 having a smooth surface is formed.

(3) The recording sheet to which the toner is fixed is released from the heat and pressure applied by the rollers 3 and 4 and discharged from the image fixing unit. The toner 1 is solidified and adheres to the recording sheet 2 upon cooling.

The above-mentioned steps will now be considered from the viewpoint of the mechanism of producing the glossiness in the surface of the fixed toner images.

Figure 3:
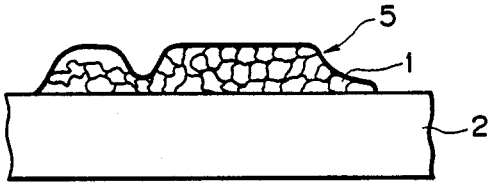
FIG. 3 is a schematic illustration of the state of the toner, which is fixed to a recording sheet.
Figure 4:
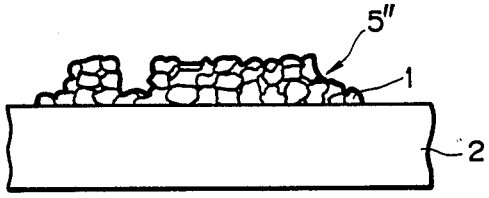
FIG. 4 is a schematic illustration of the state of a comparative toner, which is fixed to a recording sheet.

In step (1), the toner 1 begins to behave as a viscoelastic material. In step (2), the toner is deformed by the pressure applied thereto and the surface thereof is made smooth. The magnitude of the deformation and the time period for the application of the pressure are determined depending upon the conditions of the employed image fixing unit, that is, the pressure applied by the two rollers 3 and 4 and the period of time for which the nip pressure is applied, respectively. In step (3), the toner, upon being released from the pressure, exhibits a stress tending to return to its original state. In the case of a toner which is close to a viscous material, the decrease in the stress with time is so large that the recovering ratio from the deformation is small as shown in FIG. 3. Such a toner can maintain its surface smooth as shown in FIG. 3, so that glossy images can be obtained. In contrast to this, in the case of a toner which is close to an elastic material, the decrease in the stress with time is so small that the toner cannot keep its surface smooth and the surface becomes rough as shown in FIG. 4. Such a toner is not capable of yielding glossy images.

In view of the above, the dynamic viscoelasticity of a toner is considered to be an important factor for determining whether or not the toner is capable of yielding glossy images.

The inventors of the present invention investigated tan $\delta$ [G''/G'], that is, the ratio of the loss modulus [G'' ($\omega$)] indicating the elastistic property (elasticity) of the toner to the storage modulus [G' ($\omega$)] indicating the dashpot-like property (viscosity) of the toner for determining the capability of the toner to yield glossy images.

According to the present invention, when the above described tan $\delta$ of an employed toner is within the range of 1.70 to 3.00, sufficient releasability from the image fixing rollers can be attained in a thermal image fixing with application of pressure in a practically usable image fixing temperature range, since the surface of the toner images is made smooth by the plastic deformation of the toner, thereby yielding glossy images.

When the value of tan $\delta$ of the toner is less than 1.70, sufficiently high releasability is available in a wide image fixing temperature range, but the elasticity of the toner is so large that the toner images cannot be made smooth and therefore glossy images cannot be obtained.

On the other hand, when the value of tan $\delta$ of the toner is more than 3.00, the toner does not have a sufficient releasability and therefore an undesirable offset phenomenon occurs on a Teflon-coated heat application roller. In addition to this shortcoming, the toner has the shortcoming that there is no usable image fixing temperature range.

A method of measuring the above stated viscoelastic properties of toner will now be explained.

Instruments designed for measuring such rheological characteristics are generally called rheometers. The rheometer employed in the present invention is Rheometrics Dynamic Spectrometer RDS-7700 made by Rheometrics, Inc. in the United States.

In the measurement of the rheological characteristics of the toner for use in the present invention, the frequency ($\omega$) of the rheometer was preset at 10 rad/sec and the strain ratio was automatically adjusted. Under these conditions, the temperature was increased from 80° C. to 200° C., so that the temperature dependency of the rheological characteristics was tested. From the results of this test, the loss tangent (tan $\delta$) at a storage modulus (G') of $10^5$ dyne/cm$^2$ was determined. In this test, since the effective period of time required for image fixing by use of an image fixing unit including a heat application roller is generally in the range of about $1\times10^{-2}$ to about $5\times10^{-2}$ seconds, the rheological characteristics of the toner were measured at an angular frequency ($\omega$) of 100 rad/sec, which corresponds to the above effective image fixing time.

In the toner for use in the present invention, any binder resins may be employed so long as they are in general use as resins for conventional toners. However, binder resins should be selected with the viscoelastic characteristics thereof taken into consideration because the viscoelastic characteristics thereof have a significant effect on the viscoelasticity of the toner.

Specific examples of binder resins for use in the toner for the present invention are styrene and homopolymers of substituted styrene such as polystyrene, poly-p-chlorostyrene, and polyvinyl toluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl $\alpha$-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, and styrene-acrylonitrile-indene copolymer; and other resins such as polyvinyl chloride, polyvinyl acetate, polyethylene, polypropylene, silicone resin, polyester, polyurethane, polyamide, epoxy resin, polyvinyl butyral, rosin-modified resin, terpene resin, phenolic resin, xylene resin, aliphatic and alicyclic hydrocarbon resins, aromatic petroleum resins, chlorinated paraffin, and paraffin wax. These binder resins can be used alone or in combination.

Among them, styrene resin, polyester and epoxy resin are preferable for use in the toner, because they are superior to the other resins in the transparent property which is necessary for full-color image formation.

As previously mentioned, since the viscoelastic property of the binder resin has a significant effect upon the viscoelasticity of the toner itself, it is preferable that the binder resin for use in the present invention also satisfy the requirement of $1.7 \leqq \tan\delta \leqq 3.0$ of the present invention.

In general, in the binder resins having a loss tangent ($\tan\delta$) which ranges from 1.7 to 3.0, the ratio ($\overline{Mw}/\overline{Mn}$) of the weight-average molecular weight ($\overline{Mw}$) to the number-average molecular weight ($\overline{Mn}$) thereof is small, for instance, not more than 10.

As the colorants for use in the toner for the present invention, for example, the following colorants can be employed: As yellow colorants, Benzidine Yellow (for example, C.I. Pigment Yellow 12), a monoazo dye (for example, C.I. Solvent Yellow-16), nitrophenyl amine sulfonamide (C.I. Disperse Yellow 33); as magenta colorants, quinacridone (for example, C.I. Pigment Red 122), anthraquinone dye, and a diazo dye (C.I. Solvent Red 19); and as cyan colorants, Copper phthalocyanine (C.I. Pigment Blue 15) and indanthrene blue; and as black colorants, carbon black and Nigrosine dye. As a matter of course, any other conventional dyes and pigments can be employed if the toner for use in the present invention is not applied to full-color electrophotography.

The toner for use in the present invention can be used not only as a two-component developer comprising a mixture of the toner and a carrier, but also as a one-component developer for conventional development methods. When the toner is used as a two-component developer, conventional carriers such as magnetic particles including finely-divided iron particles, glass beads and the iron particles and glass beads coated with a resin.

In the present invention, the toner can be fixed to a recording sheet by use of a conventional heat and pressure application method using a heat application roller. However, as mentioned previously, since the toner layer is plastically deformed for making the toner image glossy during the heat and pressure application process, it is preferable that the heat application roller for applying pressure to the toner and the recording sheet (rigid material) be made of a rigid material. In other words, for obtaining glossy images, it is preferable to use as the heat application roller a rigid roller, since a rigid roller can apply pressure to both the toner layer and the recording sheet in the direction perpendicular thereto, which are held between the pressure application roller and the heat application roller to form a nip width therebetween.

The image fixing roller (heat application roller) for use in the image fixing unit in the present invention is a metallic hollow roller made of a metal such as aluminum, stainless steel, iron and copper, with the outer peripheral surface thereof being coated with an overcoat layer having a thickness of 20 to 100 μm made of a heat-resistant releasable type resin such as ethylene tetrafluoride. It is preferable that the surface of the image fixing roller be polished to a mirror surface having an average smoothness of 0.8Z or more at 10 points on the surface thereof in accordance with the Japanese Industrial Standards B0601 (1982). The outer peripheral surface of the image fixing roller is made smooth to the above extent, since it comes into contact with the toner layer and makes the surface of the toner image glossy.

It is necessary that the pressure application roller come into pressure contact with the image fixing roller to form a predetermined nip width at the time of image fixing by a conventional means. It is preferable that the pressure application roller be a metal core roller with the outer peripheral surface thereof being coated with a relatively thick elastic layer made of an elastic material, such as silicone rubber, fluororubber, and fluorosilicone rubber. The image fixing roller and the pressure application roller, when necessary, can be heated by a conventional method.

When necessary, liquids capable of providing the image fixing roller with excellent releasability, for example, silicone oil, may be applied to the image fixing roller for improvement of the releasability of the image fixing roller.

It is preferable that the process of applying heat and pressure by the heat application roller and the pressure application roller be carried out under application of comparatively high pressure, and more preferably, in such a manner that the roller surface pressure is in the range of 5 to 20 kg·f/cm$^2$.

The present invention will now be explained in detail with reference to the following examples.

EXAMPLE 1-1

Formulation of Toner No. 1-1

| | Parts by Weight |
|---|---|
| Styrene - n-butyl methacrylate copolymer ($\overline{Mw}$ = 33,000, $\overline{Mn}$ = 9,200, $\overline{Mw}/\overline{Mn}$ = 3.6) (Resin) | 100 |
| Copper Phthalocyanine Blue (C.I. Pigment Blue 15) (Colorant) | 5 |

A mixture of the above components was kneaded under application of heat thereto by a three-roll mill, and then allowed to cool. The kneaded mixture was roughly ground by a cutting mill and then finely pulverized by an ultrasonic jet mill fine pulverizer. The finely-pulverized mixture was classified by a zigzag-type classifier, whereby a cyan toner No. 1-1 having an average particle diameter of 11 μm was obtained.

The viscoelasticity of the cyan toner No. 1-1 represented by $\tan\delta$ was 2.60 ($G' = 10^5$ dynes/cm$^2$ at an angular frequency (w) of 100 rad/sec = 100 rad/sec).

5 parts by weight of the thus obtained toner No. 1-1 and 100 parts by weight of a ferrite carrier consisting of spherical resin-coated ferrite particles having an average particle diameter of 100 μm were mixed, whereby a cyan developer No. 1-1 was prepared.

EXAMPLE 1-2

Example 1-1 was repeated except that Copper Phthalocyanine Blue employed in Example 1-1 was replaced by 5 parts by weight of benzidine yellow (C.I. Pigment Yellow 12), whereby a yellow toner No. 1-2 was prepared. The visco-elasticity of the yellow toner No. 1-2 represented by $\tan\delta$ was 2.50.

5 parts by weight of the thus obtained toner No. 1-2 and 100 parts by weight of a ferrite carrier consisting of spherical resin-coated ferrite particles having an average particle diameter of 100 μm were mixed, whereby a yellow developer No. 1-2 was prepared.

EXAMPLE 1-3

Example 1-1 was repeated except that Copper Phthalocyanine Blue employed in Example 1-1 was replaced by quinacridone (C.I. Pigment Red 122), whereby a magenta toner No. 1-3 was prepared. The viscoelasticity of the magenta toner No. 1-3 represented by tan δ was 2.55.

5 parts by weight of the thus obtained toner No. 1-3 and 100 parts by weight of a ferrite carrier consisting of spherical resin-coated ferrite particles having an average particle diameter of 100 μm were mixed, whereby a magenta developer No. 1-3 was prepared.

The thus prepared cyan developer No. 1-1, yellow developer No. 1-2 and magenta developer No. 1-3 were subjected to the following copy making tests. In the tests, a commercially available copying machine (Trademark "Ricoh Color 5000" made by Ricoh Co., Ltd.) was employed, in which a modified image fixing unit was incorporated. This copying machine is hereinafter referred to as Modified RC-5000. In the image fixing unit of Modified RC-5000, as the heat application image fixing roller, a roller consisting of a hollow core roller having a diameter of 50 mm made of aluminum, with the outer peripheral surface thereof being coated with a Teflon resin (Trademark "Polyfluoroethylene" made by Du Pont de Nemours, E.I. and Co.) with a thickness of 50 μm was employed, and as the pressure application roller, an aluminum hollow core roller having a diameter of 50 mm, with the outer peripheral surface thereof being coated with silicone rubber (Trademark "KE-1300RTV" made by Shin-Etsu Chemical Co., Ltd.) with a thickness of 5 mm was employed.

To the surface of the heat application roller, silicone oil (Trademark "KF-96" made by Shin-Etsu Chemical Co., Ltd.) was thinly applied as an auxiliary releasability improvement agent.

The image fixing was performed under the conditions that the line speed of the rollers was 105 mm/sec, the nip width thereof (the contact width of the heat application roller and the pressure application roller) was 8 mm and the applied pressure was 8 kg·f/cm$^2$.

By use of the above prepared three developers (yellow, magenta and cyan), full-color images were formed by Modified RC-5000. In the obtained images, the surface glossiness was about 45% in the shadow portion, and about 25 to 30% in the halftone portion. The fixed images showed no glaring glossiness which is liable to occur in the image fixing by a silicone roller. The image quality was very close to the quality of the ordinary color printing, and the color formation was excellent, without any impression that the toner image layer has a certain thickness.

In addition to the above tests, single color formation was conducted by Modified RC-5000 which was set in a single color mode, using the yellow, magenta and cyan developers. The maximum image density (Max. I.D.) obtained by each of the above developers and the glossiness thereof [at Gs (60°) in accordance with JIS Z-8741 (1983), method 3] measured by an angle variation glossmeter were as shown in Table 1. As a result, single colored copies having a sufficient high glossiness and a high maximum image density were obtained.

EXAMPLE 2

Formulation of Toner No. 2

| | Parts by Weight |
|---|---|
| Styrene - ethyl methacrylate copolymer ($\overline{Mw}$ = 53,000, $\overline{Mn}$ = 18,00, and $\overline{Mw}/\overline{Mn}$ = 2.9) (Resin) | 100 |
| Carbon black (Colorant) | 8 |

A mixture of the above components was kneaded under application of heat thereto by a three-roll mill, and then allowed to cool. The kneaded mixture was roughly ground by a cutting mill and then finely-pulverized by an ultrasonic jet mill fine pulverizer. The finely-pulverized mixture was classified by a zigzag-type classifier, whereby a cyan toner No. 2 having an average particle diameter of 11 μm was obtained.

5 parts by weight of the thus obtained toner No. 2 and 100 parts by weight of a ferrite carrier consisting of spherical resin-coated ferrite particles having an average particle diameter of 100 μm were mixed, whereby a black developer No. 2 was prepared.

EXAMPLE 3

Example 2 was repeated except that the formulation of the toner in Example 2 was changed to the following formulation, whereby a cyan toner No. 3 was prepared.

Formulation of Toner No. 3

| | Parts by Weight |
|---|---|
| Styrene - maleic acid ester copolymer ($\overline{Mw}$ = 59,000, $\overline{Mn}$ = 27,000, and $\overline{Mw}/\overline{Mn}$ 2.2) (Resin) | 100 |
| Copper phthalocyanine (Colorant) | 5 |

5 parts by weight of the thus obtained toner No. 3 and 100 parts by weight of the same ferrite carrier as that employed in Example 2 were mixed, whereby a cyan developer No. 3 was prepared.

EXAMPLE 4

Example 2 was repeated except that the formulation of the toner in Example 2 was changed to the following formulation, whereby a magenta toner No. 4 was prepared.

Formulation of Toner No. 4

| | Parts by Weight |
|---|---|
| Polyester ($\overline{Mw}$ = 21,000, $\overline{Mn}$ = 4,000, and $\overline{Mw}/\overline{Mn}$ = 5.3) (Resin) | 100 |
| C.I. Pigment Red 87 (Colorant) | 5 |

5 parts by weight of the thus obtained toner No. 4 and 100 parts by weight of the same ferrite carrier as that employed in Example 2 were mixed, whereby a magenta developer No. 4 was prepared.

COMPARATIVE EXAMPLE 1-1

Example 2 was repeated except that the formulation of the toner in Example 2 was changed to the following formulation, whereby a comparative cyan toner No. 1-1 was prepared.

Formulation of Comparative Toner No. 1-1

| | Parts by Weight |
|---|---|
| Styrene - 2-ethylhexyl methacrylate copolymer ($\overline{Mw}$ = 180,000, $\overline{Mn}$ = 4,200, and $\overline{Mw}/\overline{Mn}$ = 42.9) (Resin) | 100 |
| Copper phthalocyanine blue (Colorant) | 5 |

The viscoelasticity of the comparative cyan toner No. 1-1 represented by tan δ was 1.12.

5 parts by weight of the thus obtained comparative toner No. 1-1 and 100 parts by weight of the same ferrite carrier as that employed in Example 1 were mixed, whereby a comparative cyan developer No. 1-1 was prepared.

COMPARATIVE EXAMPLE 1-2

Comparative Example 1-1 was repeated except that the colorant (copper phthalocyanine blue) in the formulation of the toner in Comparative Example 1-1 was replaced by benzidine yellow (colorant), whereby a comparative yellow toner No. 1-2 was prepared.

The viscoelasticity of the comparative yellow toner No. 1-2 represented by tan δ was 1.10.

5 parts by weight of the thus obtained comparative toner No. 1-2 and 100 parts by weight of the same ferrite carrier as that employed in Example 1 were mixed, whereby a comparative yellow developer No. 1-2 was prepared.

COMPARATIVE EXAMPLE 1-3

Comparative Example 1-1 was repeated except that the colorant (copper phthalocyanine blue) in the formulation of the toner in Comparative Example 1-1 was replaced by quinacridone (colorant), whereby a comparative magenta toner No. 1-3 was prepared.

The viscoelasticity of the comparative magenta toner No. 1-3 represented by tan δ was 1.10.

5 parts by weight of the thus obtained comparative toner No. 1-3 and 100 parts by weight of the same ferrite carrier as that employed in Example 1 were mixed, whereby a comparative magenta developer No. 1-3 was prepared.

In the single color mode copying, any of the three color (cyan, yellow and magenta) images lacked glossiness and clearness. In the full-colored mode copying, the glossiness in the shadow portion of the full-colored images was 7%, and the glossiness in the halftone portion was about 5%, which gave poor impression. The color formation of each color was no good and the obtained images looked poor.

COMPARATIVE EXAMPLE 2

Example 1 was repeated except that the formulation of the toner in Example 1 was changed to the following formulation, whereby a comparative black toner No. 2 was prepared.

Formulation of Comparative Toner No. 2

| | |
|---|---|
| Styrene - n-butyl acrylate copolymer ($\overline{Mw}$ = 220,000 $\overline{Mn}$ = 10,000, and $\overline{Mw}/\overline{Mn}$ = 22.0) (Resin) | 100 |
| Carbon black (Colorant) | 8 |

5 parts by weight of the thus obtained comparative toner No. 2 and 100 parts by weight of the same ferrite carrier as that employed in Example 1 were mixed, whereby a comparative black developer No. 2 was prepared.

COMPARATIVE EXAMPLE 3

Example 1 was repeated except that the formulation of the toner in Example 1 was changed to the following formulation, whereby a comparative cyan toner No. 3 was prepared.

Formulation of Comparative Toner No. 3

| | Parts by Weight |
|---|---|
| Styrene - methylmethacrylate copolymer (Mw = 120,000, Mn = 20,000, and Mw/Mn = 6.0) (Resin) | 100 |
| Copper phthalocyanine (Colorant) | 5 |

5 parts by weight of the thus obtained comparative toner No. 3 and 100 parts by weight of the same ferrite carrier as that employed in Example 1 were mixed, whereby a comparative cyan developer No. 3 was prepared.

COMPARATIVE EXAMPLE 4

Example 1 was repeated except that the formulation of the toner in Example 1 was changed to the following formulation, whereby a comparative magenta toner No. 4 was prepared.

Formulation of Comparative Toner No. 4

| | Parts by Weight |
|---|---|
| Polyester ($\overline{Mw}$ = 43,000, $\overline{Mn}$ = 3,100, and $\overline{Mw}/\overline{Mn}$ = 13.9 ) (Resin) | 100 |
| C.I. Pigment Red 87 (Colorant) | 5 |

5 parts by weight of the thus obtained comparative toner No. 4 and 100 parts by weight of the same ferrite carrier as that employed in Example 1 were mixed, whereby a comparative magenta developer No. 4 was prepared.

Each of the above prepared developers Nos. 1-1, 1-2, 1-3, developers Nos. 2 to 4, comparative developers Nos. 1-1, 1-2, 1-3, and comparative developers Nos. 2 to 4 were subjected to the same copy making tests as in Example 1. The results are shown in the following Table 1:

TABLE 1

| Toner Developer | | tan δ ω = 100 rad/sec | Max.I.D. (in Shadow Portion) | Gs (60°) (Halftone Portion) | Gs (60°) (Shadow Portion) |
|---|---|---|---|---|---|
| Example 1-2 | Yellow | 2.50 | 1.0* | 24 | 35 |
| Example 1-3 | Magenta | 2.55 | 1.8* | 26 | 36 |
| Example 1-1 | Cyan | 2.60 | 2.0* | 27 | 38 |
| Example 2 | | 1.72 | 1.9* | 21 | 32 |
| Example 3 | | 1.95 | 1.9* | 23 | 35 |
| Example 4 | | 2.70 | 1.8* | 27 | 40 |
| Comparative Example 1-2 | Yellow | 1.10 | 0.7* | 4 | 5 |
| Comparative Example 1-3 | Magenta | 1.10 | 1.2* | 4 | 5 |
| Comparative Example 1-1 | Cyan | 1.12 | 1.4* | 4 | 6 |
| Comparative Example 2 | | 1.25 | 1.4* | 5 | 7 |
| Comparative Example 3 | | 1.30 | 1.4* | 4 | 6 |
| Comparative Example 4 | | 1.37 | 1.2* | 7 | 9 |

*Single-color

COMPARATIVE EXAMPLE 5

Example 1 was repeated except that the formulation of the toner in Example 1 was changed to the following formulation, whereby a comparative cyan toner No. 5 was prepared.

Formulation of Comparative Toner No. 5

| | Parts by Weight |
|---|---|
| Polyester ($\overline{Mw}$ = 12,000, $\overline{Mn}$ = 3,200, and $\overline{Mw}/\overline{Mn}$ = 3.8) (Resin) | 100 |
| Copper phthalocyanine (Colorant) | 5 |

The viscoelasticity of this comparative cyan toner represented by tan δ was 3.12.

5 parts by weight of the thus obtained comparative toner No. 5 and 100 parts by weight of the same ferrite carrier as that employed in Example 1 were mixed, whereby a comparative cyan developer No. 5 was prepared.

The thus prepared comparative cyan developer No. 5 was subjected to the same copy making tests as in Example 1. The result was that the offset phenomenon took place at low temperatures, so that images were not obtained.

In the present invention, any conventional and novel area gradation methods can be employed for the reproduction of continuous image gradations. For the dot pattern reproduction, any conventional dot configuration methods such as the Bayer method, the halftone method, and the spiral method, can be employed.

Furthermore, in the case where a recording means is capable of reproducing dots not only with the densities of "1(on)" and "0(off)", but also with the intermediate densities of, for example, "$\frac{1}{2}$", "$\frac{1}{3}$" and "$\frac{2}{3}$", a reproduction method of multi-value area-gradation can also be employed. In this gradation reproduction method, since areas are modulated, similar advantages to the advantages obtained by the present invention can be obtained.

Area-Gradation Method

Six toner developers A through F were prepared as follows:

The components of each toner developer as shown below are dispersed in a ball mill for 24 hours. The dispersed mixture was kneaded in a heated roll mill including two rollers. After the kneaded mixture was cooled, it was crushed roughly in a hammer mill, then finely divided in a jet mill, whereby finely-divided toner particles A through F having a particle diameter ranging from 1 μm to 30 μm, with a volume mean diameter of 11 μm, were obtained.

| | Parts by Weight |
|---|---|
| (1) Toner A | |
| Styrene - n-butyl methacrylate [7:3] copolymer ($\overline{Mw}$ = 62,000, $\overline{Mn}$ = 18,000 and tan δ = 2.20 where G' = $10^5$ dynes/cm$^2$) (hereinafter tan δ represents a value where G' = $10^5$ dynes/cm$^2$) | 100 |
| Copper phthalocyanine blue (C.I. Pigment Blue 15) [tan δ of toner A: 2.25] | 5 |
| (2) Toner B | |
| Styrene - n-butyl methacrylate [7:3] copolymer ($\overline{Mw}$ = 29,000, $\overline{Mn}$ = 9,500 and tan δ = 3.28) | 100 |
| Copper phthalocyanine blue [tan δ of toner B: 3.30] | 5 |
| (3) Toner C | |
| Styrene - n-butyl methacrylate [7:3] copolymer ($\overline{Mw}$ = 220,000, $\overline{Mn}$ = 13,00 and tan δ = 1.45) | 100 |
| Copper phthalocyanine blue [tan δ of toner C: 1.46] | 5 |
| (4) Toner D | |
| Polyester ($\overline{Mw}$ = 37,200, $\overline{Mn}$ = 4,100, and tan δ = 2:82) | 100 |
| 2,9-dimethyl quinacridone [tan δ of toner D: 2.82] | 4 |
| (5) Toner E | |
| Polyester ($\overline{Mw}$ = 2,200, $\overline{Mn}$ = 8,100, and tan δ = 3.50) | 100 |
| 2,9-dimethyl quinacrydone [tan δ of toner E: 3.54] | 4 |
| (6) Toner F | |
| Polyester ($\overline{Mw}$ = 2,200, $\overline{Mn}$ = 8,100, and tan δ = 1.48) | 100 |
| 2,9-dimethyl quinacrydone | 4 |

-continued

| | Parts by Weight |
|---|---|
| [tan δ of toner F: 1.47] | |

8 parts by weight of each of the above toners A through F and 92 parts by weight of iron powder (Trademark "TEFV250 ~400" made by Nippon Teppun Co., Ltd. ) were separately mixed, whereby six toner developers A through F were prepared.

By use of the following two types of image fixing units A and B, each comprising a heat application roller and a pressure application roller, image fixing tests were performed, with a heater incorporated in each heat application roller, under the conditions that the nip width, plane pressure and line speed of the two rollers were the same, with slight application of silicone oil (Trademark "KF-96" made by Shin-Etsu Chemical Co., Ltd.) to the heat application roller to improve the releasability thereof:

Image fixing unit A

Heat application roller: an aluminum core roller coated with Teflon with a thickness of 50 μm, having a diameter of 40 mm, the surface thereof being polished to 0.8Z.

Pressure application roller: an aluminum core roller having a wall thickness of 5 mm coated with RTV, having a diameter of 40 mm.

Image fixing conditions: Nip width, 7 mm, line speed, 90 mm/sec, and surface plane pressure, 7 kg·f/cm$^2$.

Image fixing unit B

Heat application roller: an aluminum core roller coated with RTV (Trademark "KE-1300-2" made by Shin-Etsu Chemical Co., Ltd.), a silicone fluoride, and HTV, with the total thickness of the three layers being 3 mm, having a diameter of 40 mm.

Pressure application roller: an aluminum core roller coated with Teflon with a thickness of 20 mm, having a diameter of 40 mm.

Image fixing conditions: Nip width, 7 mm, line speed, 90 mm/sec, and surface plane pressure, 7 kgf/cm$^2$.

The above image fixing units A and B were driven in rotation by an external motor so to set up image fixing units capable of fixing toner images to a recording sheet outside the copying machine.

Area-Gradation Method

As an image formation apparatus, a commercially available copying machine (Trademark "FT-5520" made by Ricoh Co., Ltd.) was employed, in which a positive-positive printer and a 400 dpi laser writing system were incorporated and from which an image fixing unit is removed so as to make it possible to form unfixed images on a recording sheet.

In this image formation apparatus, an area-gradation method was employed as image gradation reproduction method, by which 17 (=4×4+1) image gradations were obtained with the dot coverage areas changed in a spiral configuration in a 4×4 dot matrix.

Density-Gradation Method

The same image formation apparatus as that employed in the above area-gradation method was employed, from which the image fixing unit was removed so as to form unfixed images on a recording sheet. In this image formation apparatus, a density-gradation method was employed, in which the surface potential of the photoconductor in the image formation apparatus was analogously changed, whereby the amount of the toner deposition on the photoconductor was also analogously changed and accordingly the obtained image density was also analogously changed. For obtaining different image densities, a Kodak gray scale was copied with different development bias voltages.

Unfixed toner images were formed by use of the previously mentioned six toners A through F in accordance with the above-mentioned area-gradation method and density-gradation method. The unfixed toner images were then fixed to recording sheets by the external image fixing units A and B.

By use of each toner in accordance with the area-gradation method and density-gradation method, 24 copies were obtained, and the image fixing performances and image qualities obtained by each toner and each gradation method are shown in the following Table 2.

TABLE 2

| Image Fixing Unit | Gradation Reproduction Method | Type of Toner | | | | | |
|---|---|---|---|---|---|---|---|
| | | Toner A | Toner B | Toner C | Toner D | Toner E | Toner F |
| Image Fixing Unit A (Rigid heat application roller coated with Teflon) | Area gradation method | Good image fixing Sufficiently glossy even in low I.D. image areas (◎) | Offset development occurs at low temperatures Impractical temperature image fixing | Good image fixing Not glossy over the entire image areas (XX) | Good image fixing Sufficiently glossy even in low I.D. image areas (◎) | Offset development occurs at low temperatures Impractical temperature image fixing | Good image fixing Not glossy over the entire image areas (XX) |
| | Density-gradation method | Good image fixing Insufficiently glossy in low I.D. image areas (Δ) | Same as above | Same as above | Good image fixing Insufficiently glossy in low I.D. image areas (Δ) | Same as above | Same as above |
| Image Fixing Unit B (Elastic heat application roller coated with | Area gradation method | Good image fixing Insufficiently glossy over the entire image areas (Δ~X) | Good image fixing Sufficiently glossy in high I.D. image areas (Δ) | Image Fixing at high temperatures Not glossy over the entire image areas | Good image fixing Insufficiently glossy over the entire image areas (Δ~X) | Good image fixing Sufficiently glossy in high I.D. image areas (Δ) | Image Fixing at high temperatures Not glossy over the entire image areas |
| | Density- | Same as above | Same as above | Same as above | Same as above | Same as above | Same as above |

TABLE 2-continued

| Image Fixing Unit | Gradation Reproduction Method | Type of Toner | | | | | |
|---|---|---|---|---|---|---|---|
| | | Toner A | Toner B | Toner C | Toner D | Toner E | Toner F |
| silicone rubber | gradation method | (X) | (O) | | (X) | (O) | |

Marks in the parentheses indicate the evaluation ranks of the total image quality.

[ ◎○Δ X XX → Superior Inferior ] : The image quality becomes inferior in the right direction of the arrow, judging from the glossiness and gradation.

As shown in Table 2, toner C and toner F (tan δ thereof being less than 1.70) did not produce sufficiently glossy images even when any of the image fixing units A and B was employed. When toner B and toner E (tan δ thereof being more than 3.00) were employed in the image fixing unit A including a Teflon-coated rigid heat application roller, an offset phenomenon occurred at low temperatures and a practically usable temperature range for fixing was not available. Thus this combination cannot be employed in practice.

Toner A and Toner D (tan δ thereof ranging from 1.70 to 3.00) showed good fixing performance in both the image fixing units A and B. However, when the image fixing unit B including an elastic heat application roller coated with a silicone rubber was employed with toner A and toner B, the obtained images were not glossy enough and the glossiness thereof was 10% or less.

Therefore the preferable combinations for obtaining desirable images with appropriate glossiness are the combination of toner A or toner D ($1.70 \leqq \tan\delta \leqq 3.00$) and the image fixing unit A, and the combination of toner B or toner E ($\tan\delta \geqq 3.00$) and the image fixing unit B.

The relationship between the glossiness and image density obtained by the combinations of the image fixing unit A and toner A and the combination of the image fixing unit B and toner B according to the area-gradation and density-gradation reproduction methods are shown in Table 3.

TABLE 3

| Combination of Image Fixing Unit and Toner | Area-Gradation Method Relationship between glossiness and I.D. | Density-Gradation Method |
|---|---|---|
| Combination of image fixing unit A (Teflon-coated heat application roller) and toner A (tan δ = 2.25) | 10.2% (0.5)<br>16.0% (1.0)<br>17.2% (1.5)<br>I: ◎ | 7.4% (0.5)<br>11.0% (1.0)<br>15.1% (1.5)<br>II: Δ |
| Combination of image fixing unit B (Silicone rubber-coated heat application roller) and toner B (tan δ = 3.30) | 4.4% (0.5)<br>10.7% (1.0)<br>20.9% (1.5)<br>III: Δ~X | 5.0% (0.5)<br>12.5% (1.0)<br>IV: O |

Marks ◎○, Δ and X) represent the total image quality evaluated by visual inspection.

[ ◎○Δ X → Superior Inferior ] : The image quality becomes inferior in the right direction of the arrow.

Figure 5:
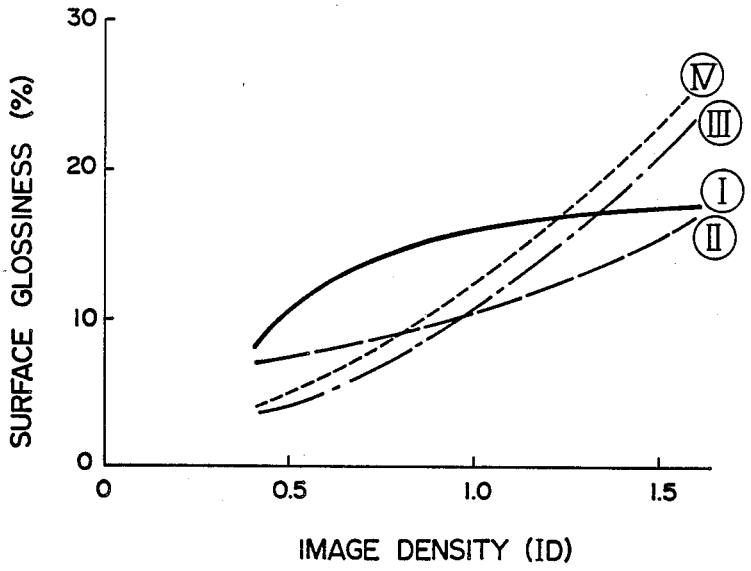
FIG. 5 is a graph showing the relationship between the image density of the images obtained by use of the toner according to the present invention and the surface glossiness of the images.

The relationship between the glossiness and image density (I.D.) in each of the above combinations is shown in FIG. 5.

As shown in FIG. 5, images formed by the combination I in Table 3 according to the present invention have almost the same high glossiness throughout the range from low image density to high image density. Thus, the combination I produces significantly high image quality. In contrast to this, the other combinations cannot yield sufficiently high glossiness in the low image density area. Although these combinations produce sufficiently high glossiness in the high image density area, the total image quality looks poor due to the different glossinesses in the low image density area and in the high image density area.

The same thing can also be said with respect to toner D and toner E. Even when the conditions of the image fixing units and the mode of the area-gradation method (dot configuration or dot matrix size) were changed, the result was the same.

Relationship between preferred images and the glossiness thereof

In an intermediate or lower image density area (hereinafter defined as the area under 1.0 of I.D.), the combination I yields a higher surface glossiness than the other combinations and the glossiness in the intermediate or lower image density area is different from that in the maximum image density area. In general pictorial images, the ratio of the intermediate or lower image density area to the entire image area is so high that the images obtained by the combination I look most preferable in terms of the overall image quality. This is probably because the glossiness determines the overall image quality. Furthermore, it is important that the difference between the glossiness in the intermediate or lower image density area and the glossiness in the area with an image density above the intermediate image density is small, because in this case, the uniformity of the image density is high. In the other combinations, the above-mentioned difference is so large that the large difference in the glossiness works as noise and decreases the uniformity of images and degrades the image quality.

Improvement of the glossiness in the area having an image density lower than the intermediate image density The electrographic process for use in the present invention will now be explained from the viewpoint of the improvement of the glossiness of images to attain high image quality.

Figure 6A:
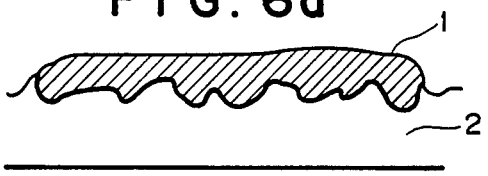
FIGS. 6*a* through 6*e* are schematic illustrations of the image fixing mechanism of a toner to a recording sheet.
Figure 6B:
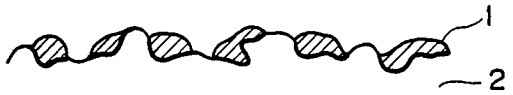

The mechanism of producing glossy images by an image fixing unit including a silicone rubber roller (heat application roller) is as follows:

A toner having a relatively low melting viscosity is capable of yielding highly glossy images by the image fixing with a silicone rubber roller. This is because when the toner is melted, its surface tension decreases, so that a mirror surface is formed on the melted toner by the pressure applied thereto by an image fixing roller and a pressure application roller, whereby glossy images are produced. For this reason, it is required that the toner employed in the above image fixing unit have good releasability. When a formed toner layer is thick, the mirror surface can be obtained as shown in FIG. 6*a*. However, when the toner layer is thin, it is difficult to form a mirror surface because of the unevenness of the paper surface as shown in FIG. 6*b*, so that the glossiness is decreased. When the toner layer is thin, the exposed areas on the surface of the paper surface degrade the glossiness, but this effect on the glossiness is separately considered from the above.

Figure 6C:
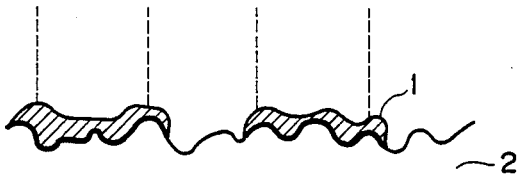
Figure 6D:
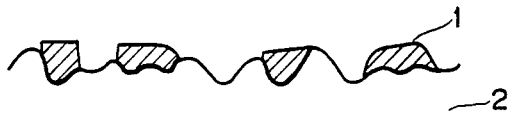

Furthermore, in the above-mentioned mechanism, the toner is apt to flow into the concave portions or between the fibers in the surface of paper and in the gaps between the texture of the paper in the low image density areas as shown in FIG. 6*c*.

Figure 6E:
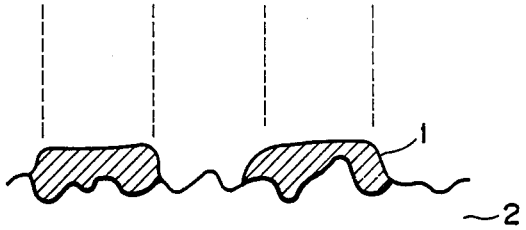

On the other hand, in the mechanism of producing glossy images by an image fixing unit including a Teflon roller (rigid heat application roller), when the toner is softened, it is plastically deformed by the application of the rigid roller, whereby glossy images are obtained. Therefore, the obtained glossiness is hardly affected by the uneveness of the surface of the paper as shown in 6*d*. In this mechanism, since the glossiness is induced by the toner with a comparatively high melting viscosity, the toner rarely flows into the texture of paper. Furthermore, since the heat application roller is rigid and the pressure application direction thereof is limited to the vertical direction, a surface mirror is easily formed as illustrated in FIG. 6*e*.

In the fixing mechanism by using the Teflon roller, better glossiness and image quality can be obtained by the area gradation method. This is because not only this fixing method by using the Teflon roller has the advantage in yielding the glossiness in the low density areas, but also the area-gradation method itself functions effectively. In an ideal area-gradation method, the matrix in a maximum density area is 100% solid, while in a highlight area, the toner is deposited in an amount corresponding to the high-light degree, with the thickness of the toner layer is the same both in the maximum density are and the high light area. Further in the area gradation reproduction, the surface potential of the photoconductor is subjected to ON and OFF control. Therefore, higher thickness uniformity and surface uniformity can be obtained in the toner layer by the area-gradation reproduction than by the density-gradation reproduction.

For the above reasons, it is considered that preferable images can be obtained by the combination of the use of an image fixing unit including a Teflon heat application roller, and a toner having a loss tangent (tan δ) ranging from 1.70 to 3.00 ($1.70 \leqq \tan\delta \leqq 3.00$).

Figure 7:
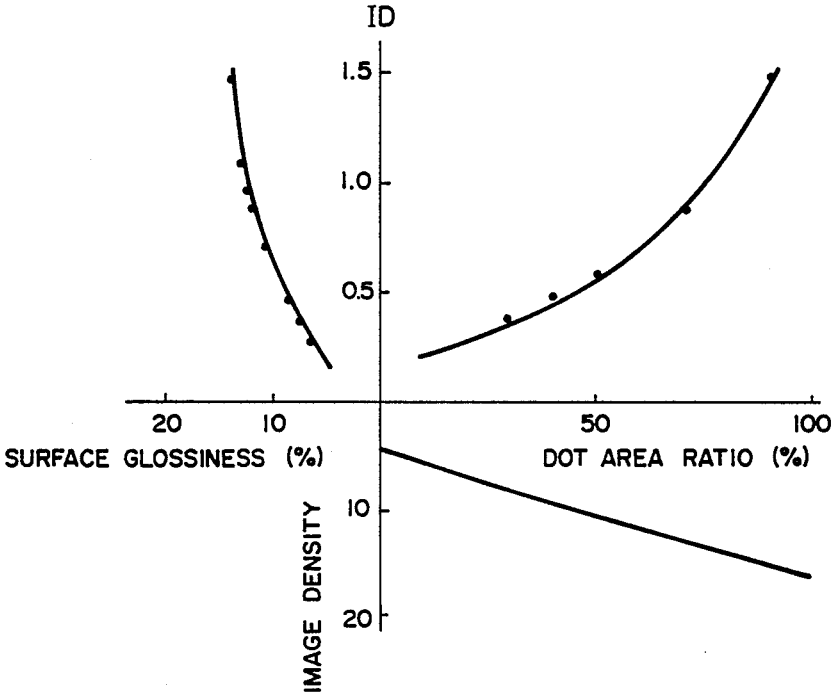
FIG. 7 is a graph showing the relationship among the area ratio, image density and surface glossiness of the obtained images.

The relationship between the dot area ratio, image density and the image glossiness (dot area+non-dot area) obtained in the process according to the present invention was investigated. The result was that the above relationship almost corresponded to the theoretical relationship as shown in FIG. 7, which indicates that an appropriate image gradation is obtained by the present invention. In contrast to this, the area-gradation reproduction is not appropriately carried out by the fixing unit employing the silicone rubber heat application roller, for instance, due to the adverse effect of dot gain.

In the above, the present invention is explained with respect to only the reproduction of opaque images is explained. However, the present invention can also be applied to transparent images (for instance, transparent colored images) for use in an overhead projector (OHP) by use of a transparent film instead of transfer paper, and transparent toners instead of the above mentioned opaque toners.

What is claimed is:

1. An electrophotographic process for producing color copies comprising the steps of: forming latent electrostatic images on a photoconductive material, developing said latent electrostatic images with a toner to toner images, transferring said toner images to a recording sheet, fixing said toner images to said recording sheet by causing said toner image bearing recording sheet to pass between a heat application roller coated with a fluorine-containing resin and a pressure application roller for applying pressure to said toner images for fixing said toner images to said recording sheet, in which the rheological characteristics of said toner are such that the loss tangent (tan δ), which is a ratio of a loss modulus (G″) to a storage modulus (G′) of said toner, is in the range of 1.70 to 3.00 when the storage modulus (G′) is $10^5$ dynes/cm$^2$, namely $$1.70 \leqq \tan\delta \leqq 3.00$$

where $$\tan\delta = \frac{\text{Loss Modulus } (G'')}{\text{Storage Modulus } (G')}.$$

2. The electrographic process as claimed in claim 1, further comprising a step of performing an area-gradation method when developing said electrostatic images to toner images.

3. An electrographic process for forming a color image comprising the steps of forming latent electrostatic images on a photoconductive material, developing said latent electrostatic images to color images with at least one color toner selected from the group consisting of a cyan toner, a yellow toner and a magenta toner, transferring said toner images to a recording sheet, fixing said toner images to said recording sheet by causing said toner image bearing recording sheet to pass between a heat application roller coated with a fluorine-containing resin and a pressure application roller for applying pressure to said toner images for fixing said toner images to said recording sheet, in which the rheological characteristics of said toner are such that the loss tangent (tan δ), which is a ratio of a loss modulus (G″) to a storage modulus (G′) of said toner, is in the range of 1.70 to 3.00 when the storage modulus (G′) is $10^5$ dynes/cm$^2$, namely $$1.70 \leqq \tan\delta \leqq 3.00$$

where $$\tan\delta = \frac{\text{Loss Modulus } (G'')}{\text{Storage Modulus } (G')}.$$

* * * * *